US009149409B2

(12) United States Patent
Numata et al.

(10) Patent No.: US 9,149,409 B2
(45) Date of Patent: Oct. 6, 2015

(54) BACK KNEADING DEVICE AND CHAIR-TYPE MASSAGE APPARATUS EQUIPPED WITH THE BACK KNEADING DEVICE

(75) Inventors: Koichi Numata, Osaka (JP); Shinsaku Shimizu, Osaka (JP); Fumitaka Ishiguro, Osaka (JP)

(73) Assignee: DAITO ELECTRIC MACHINE INDUSTRY COMPANY LIMITED, Osaka (JP)

( * ) Notice: Subject to any disclaimer, the term of this patent is extended or adjusted under 35 U.S.C. 154(b) by 584 days.

(21) Appl. No.: 13/551,256

(22) Filed: Jul. 17, 2012

(65) Prior Publication Data

US 2014/0024983 A1 Jan. 23, 2014

(51) Int. Cl.

| | |
|---|---|
| ***A61H 15/00*** | (2006.01) |
| ***A61H 7/00*** | (2006.01) |
| ***A61H 23/00*** | (2006.01) |

(52) U.S. Cl.

CPC ..... *A61H 7/007* (2013.01); *A61H 15/0078* (2013.01); *A61H 23/006* (2013.01); *A61H 2015/0014* (2013.01); *A61H 2201/0149* (2013.01); *A61H 2201/1623* (2013.01); *A61H 2201/1664* (2013.01); *A61H 2201/1669* (2013.01); *A61H 2201/1676* (2013.01); *A61H 2201/5035* (2013.01); *A61H 2205/081* (2013.01)

(58) Field of Classification Search

CPC ... A61H 15/00; A61H 15/0078; A61H 23/00; A61H 23/006

USPC ..... 601/23, 24, 26, 84, 8, 90, 92, 93, 94, 601/97, 98, 99, 100, 101, 102, 103, 10, 7, 601/108, 111, 133, 134, 136

See application file for complete search history.

(56) References Cited

U.S. PATENT DOCUMENTS

| | | | | |
|---|---|---|---|---|
| 2004/0186398 | A1* | 9/2004 | Furuie | 601/99 |
| 2009/0149784 | A1* | 6/2009 | Morita et al. | 601/94 |
| 2011/0118636 | A1* | 5/2011 | Kitamura et al. | 601/84 |
| 2011/0275968 | A1* | 11/2011 | Liu et al. | 601/134 |

FOREIGN PATENT DOCUMENTS

| | | | |
|---|---|---|---|
| JP | 2006149855 | | 6/2006 |
| JP | 2006149855 | A | 6/2006 |
| JP | 2009056018 | A | 3/2009 |
| JP | 2010-252905 | | 11/2010 |
| JP | 2010252905 | A | 11/2010 |
| JP | 2012165852 | A | 9/2012 |

* cited by examiner

*Primary Examiner* — Quang D Thanh

(57) ABSTRACT

The back kneading device mounted in the chair-type massage apparatus comprises: the massage mechanism including paired right-hand and left-hand massage members having the treatment element for massage and the driving section for transmitting massage action to the massage member; the base member for supporting the massage mechanism, with the massage member pointing forward; the vertical movement mechanism for moving the base member in the vertical direction in the backrest; and the protruding-amount varying mechanism for moving the massage member so that protrusion amount of the treatment element in the front-rear direction can be varied.

7 Claims, 13 Drawing Sheets

BACK KNEADING DEVICE AND CHAIR-TYPE MASSAGE APPARATUS EQUIPPED WITH THE BACK KNEADING DEVICE

TECHNICAL FIELD

The present invention relates to a back kneading device for massaging the back of a user and a chair-type massage apparatus equipped with the back kneading device.

BACKGROUND ART

There is a heretofore known chair-type massage apparatus that has mounted in its backrest a massage mechanism in which a pair of right-hand and left-hand massage members are operated to provide a massage action. This massage mechanism is required to move so as to conform to the spine of a user sitting on a seat of the apparatus, and is therefore provided with a vertical movement mechanism. The massage mechanism and the vertical movement mechanism constitute a back kneading device. As a back kneading device of this type, there has been proposed a device equipped with an advancing and retracting mechanism capable of causing a massage member to protrude forward beyond a normal massage position, as well as to return it to the original normal position (refer to Patent Literature 1, for example).

In this advancing and retracting mechanism, a base member, which is moved up and down in the backrest by the vertical movement mechanism, is provided independently of the massage mechanism. The massage mechanism is supported on this base member in such a manner that the upper end of the massage mechanism can be rocked back and forth about a lower pivot shaft. Moreover, over the base member, there is disposed a slider which is raised and lowered by a feed screw mechanism having a longitudinally pointing axis. The slider and the upper end of the massage mechanism are coupled to each other by a transmission arm.

That is, as the slider placed over the base member is raised, the upper end of the massage mechanism is pushed forward via the transmission arm, whereupon the massage mechanism is rocked, at its upper end, forward about the lower pivot shaft as a pivotal point. In this way, the right-hand and left-hand massage members are caused to protrude forward.

PRIOR ART REFERENCE

Patent Literature

Patent literature 1: Japanese Unexamined Patent Publication JP-A 2010-252905

SUMMARY OF THE INVENTION

Problems to be Solved by the Invention

In the chair-type massage apparatus equipped with the back kneading device as disclosed in Patent literature 1, the massage member can be driven to protrude forward and return to the original normal position just by operating the advancing and retracting mechanism. This construction yields a high level of user satisfaction with massage treatment. However, the advancing and retracting mechanism includes arcuate rail sections for guiding the upper end of the transmission arm in forward movement during the up-and-down movement of the slider, a rocking motion control mechanism for restricting a tilt of the massage member, and so forth. This leads to an undesirable increase in dimension of the back kneading device in a direction of from front to rear thereof, or the front-rear direction (increase in thickness) (for example, refer to FIGS. 1 and 2 in Patent Literature 1).

The present invention has been devised in view of the circumstances as mentioned supra, and accordingly its object is to provide a back kneading device that is, while being slimmed down in the front-rear direction (thickness-wise direction), configured to be capable of moving a massage member forward to an adequate extent, and also a chair-type massage apparatus equipped with this back kneading device.

Means for Solving the Problem

In order to accomplish the above object, the following technical means is adopted for the implementation of the present invention. The back kneading device of the present invention is a back kneading device that is mounted in a backrest against which a user is able to lean his/her back. The back kneading device comprises: a massage mechanism including a pair of right-hand and left-hand massage members each having a treatment element for providing a massage and a driving section for transmitting a massage action to the massage members; a base member for supporting the massage mechanism, with the massage member pointing forward; a vertical movement mechanism for allowing the base member to move up and down in a vertical direction inside the backrest; and a protruding amount varying mechanism for moving the massage member so that the amount of protruding movement of the treatment element in a front-rear direction can be varied.

It is preferable that the base part of the massage member is pivoted by a horizontally pointing axis for axial rocking motion, and the protruding amount varying mechanism imparts axial rocking motion to the base part of the massage member so that the amount of protruding movement of the treatment element in the front-rear direction can be varied. It is advisable that the driving section of the massage mechanism includes a kneading driving portion for driving the massage members in such a manner that the opposed treatment elements move closer to and away from each other in a horizontal direction to produce a kneading massage action, and a tapping driving portion for driving the massage member in such a manner that the treatment element is moved reciprocally in the front-rear direction or vertical direction by repetitive axial rocking motions of the base part of the massage member to produce a tapping massage action. It is also advisable that the tapping driving portion is configured for up-and-down movement in the vertical direction in the base member, and the vertical movement of the tapping driving portion allows the axial rocking motion of the base part of the massage member. Moreover, it is advisable that the protruding amount varying mechanism is configured to vary the amount of protruding movement of the treatment element in the front-rear direction by moving the tapping driving portion in the vertical direction while imparting axial rocking motion to the base part of the massage member.

Moreover, it is preferable that the protruding amount varying mechanism includes: a first restraint part for retaining a rocking angle of the massage member in a condition where the treatment element assumes a fully retracted position; a second restraint part for retaining a rocking angle of the massage member in a condition where the treatment element assumes a fully advanced position; and a non-restraint part lying between the first restraint part and the second restraint part, for permitting axial rocking motion of the base part of the massage member.

Moreover, the kneading driving portion can be configured to include a first rotary shaft installed in a hanging fashion so as to run in the horizontal direction, the massage member mounted for free rotation relative to the first rotary shaft, and a swing preventive mechanism engaging the base part of the massage member, for restraining the massage member from rotating dependently with a rotation of the first rotary shaft. The tapping driving portion can be configured to include a second rotary shaft disposed in parallel with the first rotary shaft, an eccentric driver mounted eccentrically with respect to the second rotary shaft, and a crankshaft which has its one end coupled thereto for reception of an eccentric rotation from the eccentric driver and has the other end coupled to the swing preventive mechanism, for causing the base part of the massage member to rock about the first rotary shaft by exploiting the eccentric rotation from the eccentric driver. The protruding amount varying mechanism can be configured to cause the base part of the massage member to rock about the first rotary shaft via the crankshaft by moving the tapping driving portion in the vertical direction in the base member.

Moreover, it is advisable that the protruding amount varying mechanism comprises: a guide body which has a slot pointing in the vertical direction and is secured to the tapping driving portion; a slider which is shorter than the slot of the guide body and is free to slide in the vertical direction inside the slot; and a feed screw shaft engaging the slider, for allowing the slider to move up and down through a screw rotation. It is also advisable that the upper edge of the slot formed in the guide body serves as the first restraint part, the lower edge of the slot serves as the second restraint part, and a midportion of the slot in the vertical direction serves as the non-restraint part.

It is advisable that the treatment element is composed of an upper treatment element and a lower treatment element supported in a position below the upper treatment element. It is very preferable to construct a chair-type massage apparatus comprising a seat and a backrest which is disposed at the rear of the seat and has the back kneading device as described heretofore mounted therein. It is preferable that the protruding amount varying mechanism comprises an electric motor which drives the protruding amount varying mechanism. The electric motor is disposed on the back side of the base member and on the opposite side of the driving section which drives the massage member with the base member therebetween.

Advantageous Effects of the Invention

In the back kneading device and the chair-type massage apparatus equipped with the back kneading device pursuant to the present invention, not only it is possible to achieve reduction in size in the front-rear direction (thickness-wise direction), but it is also possible to cause the massage member to protrude forward to an adequate extent.

MODES FOR CARRYING OUT THE INVENTION

Figure 10:
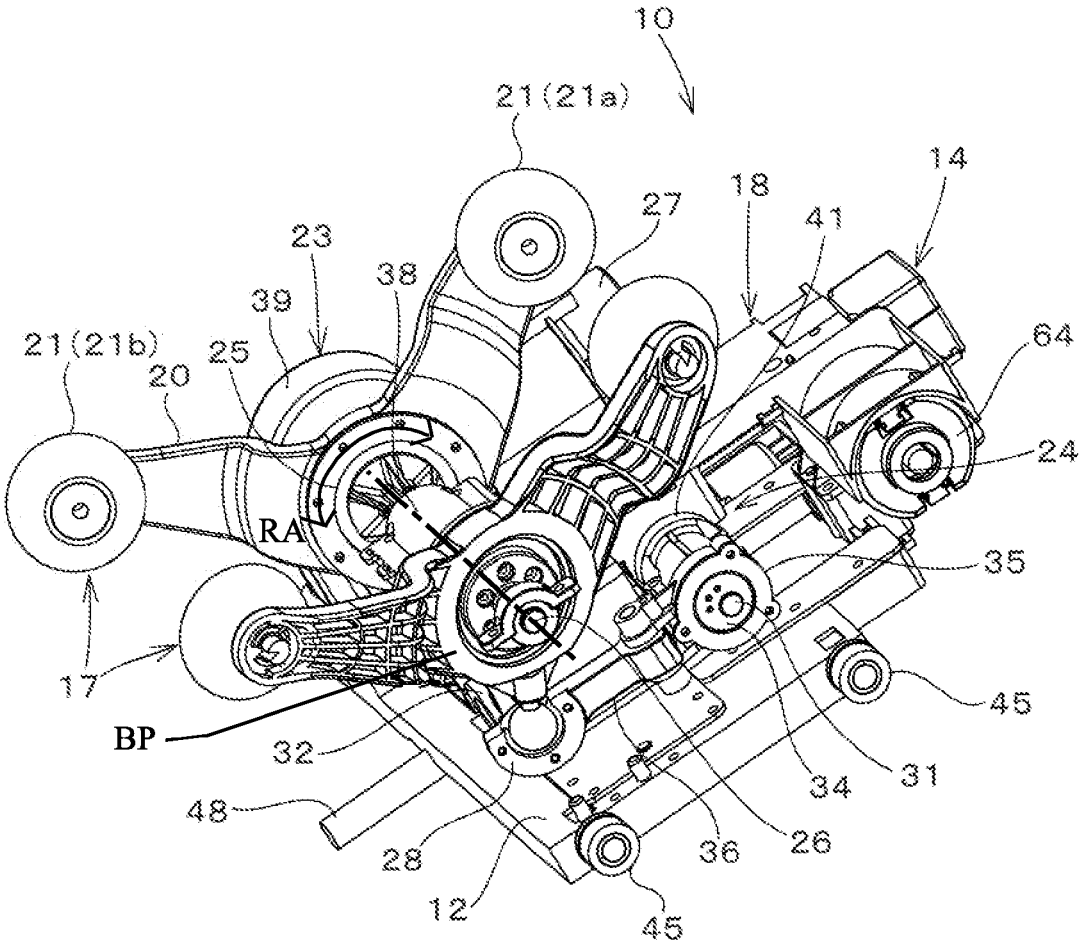
FIG. 10 is a perspective view of the massage mechanism.
Figure 11:
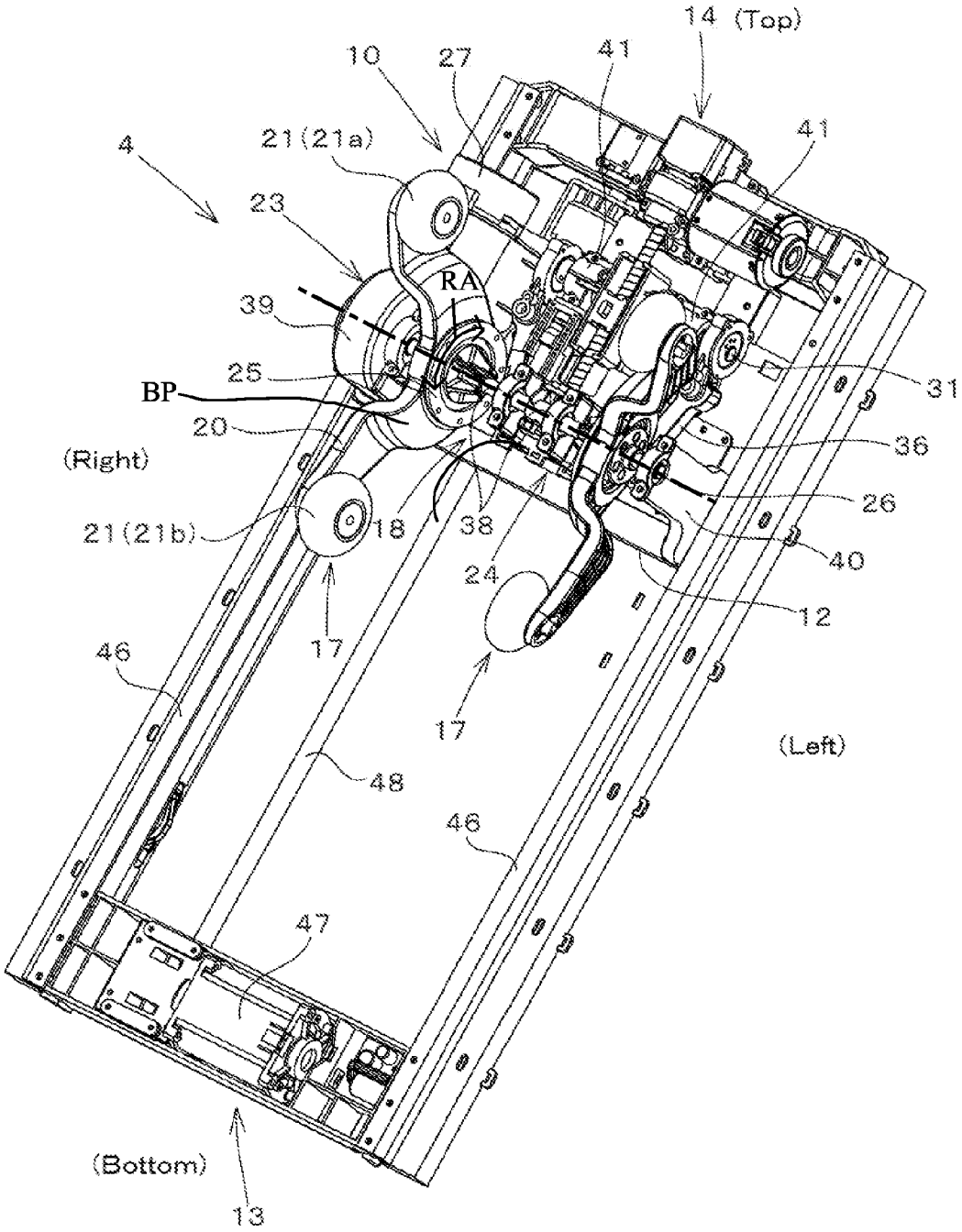
FIG. 11 is a perspective view of a back kneading device having the massage mechanism.
Figure 12:
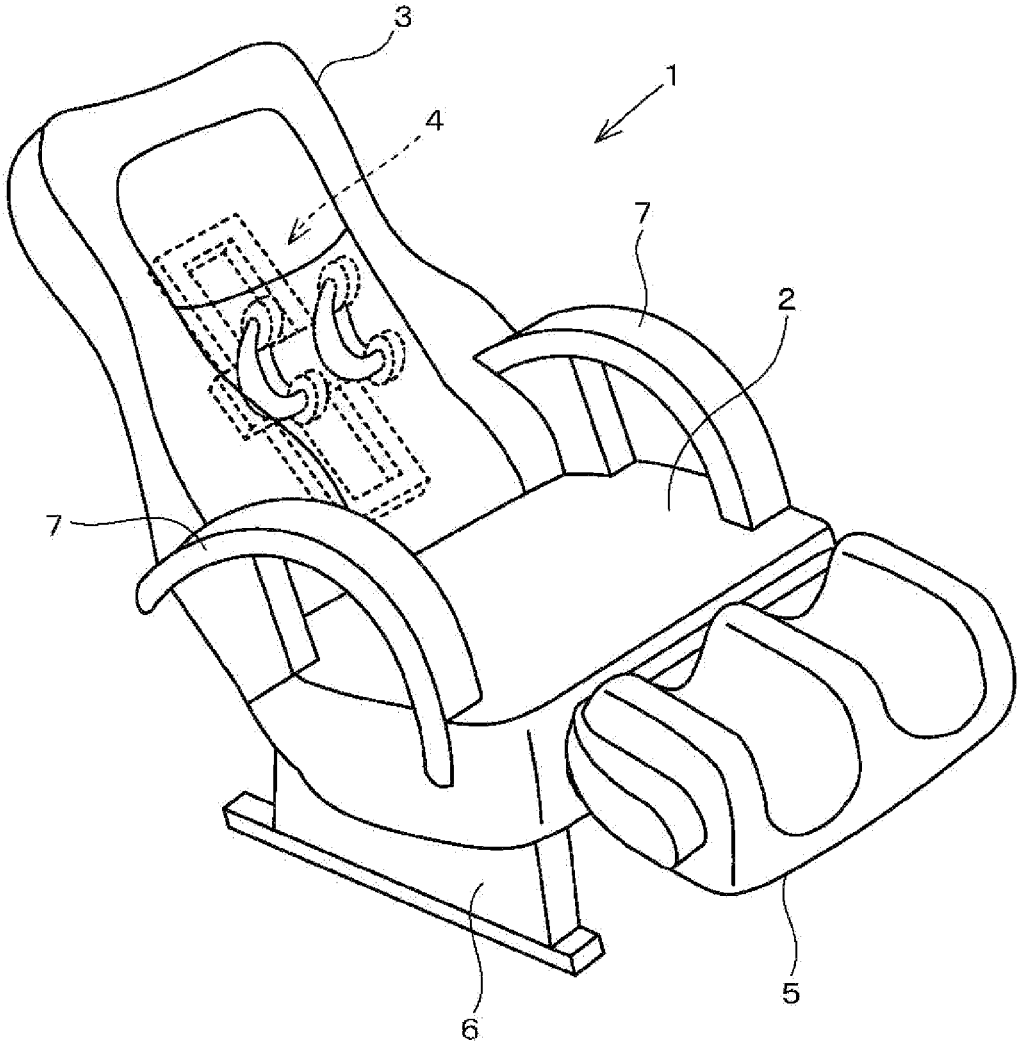
FIG. 12 is a perspective view showing a chair-type massage apparatus equipped with the back kneading device pursuant to the present invention.

Hereinafter, embodiments of the present invention will be described with reference to the drawings. FIGS. 1 through 12 show one embodiment of a chair-type massage apparatus equipped with a back kneading device pursuant to the present invention. As shown in FIG. 12, the chair-type massage apparatus 1 comprises a seat 2 having an area wide enough to support the buttocks of a user from below and a backrest 3 mounted at the rear of the seat 2. In addition, a back kneading device 4 (a massage device for performing a kneading or tapping massage throughout the back of a user from the shoulders to the waist) is mounted inside the backrest 3.

Figure 1:
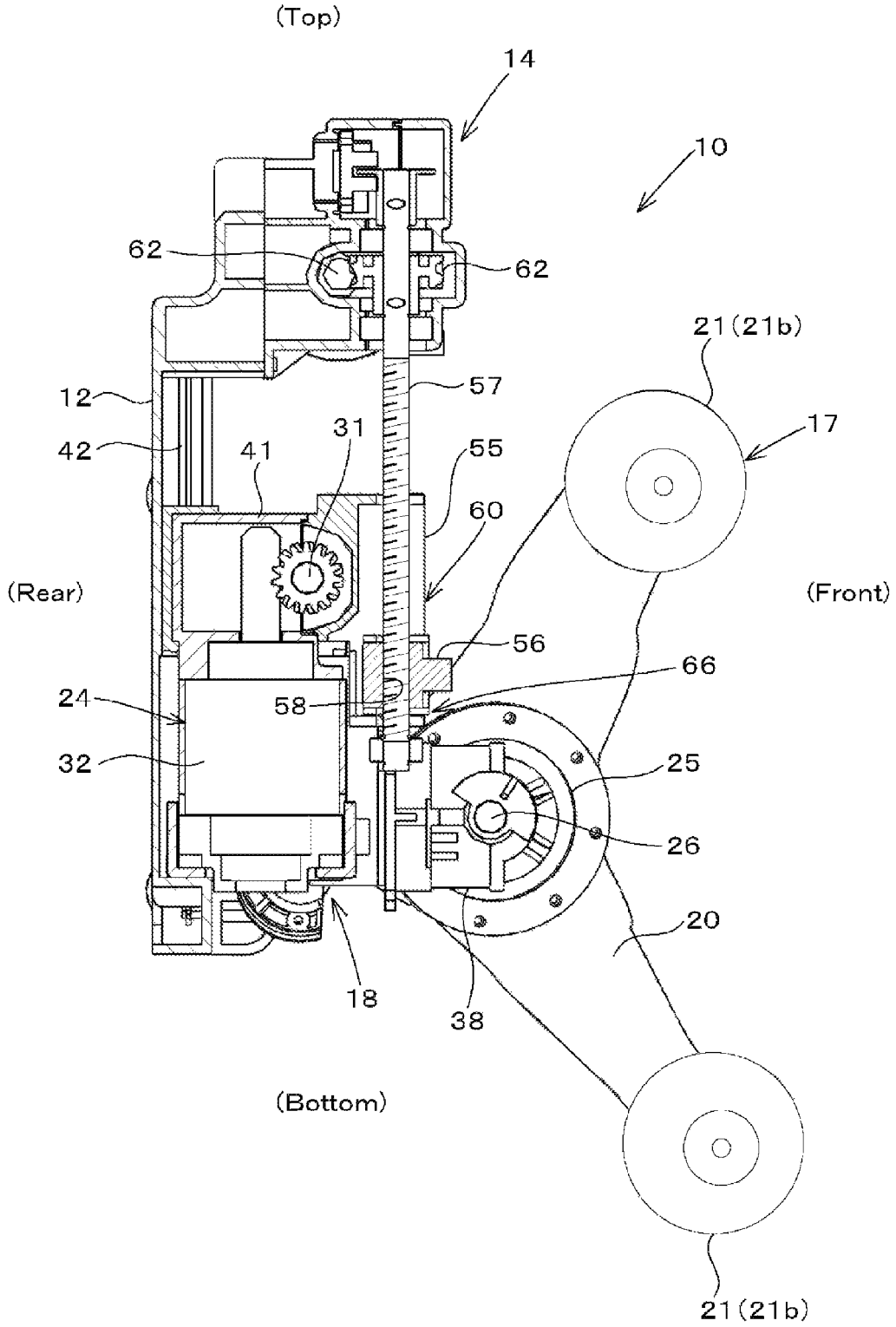
FIG. 1 is a sectional view of a massage mechanism taken along the line A-A of FIG. 7.

Under the seat 2, there is disposed a leg frame 6 for the placement of the chair-type massage apparatus 1 on a floor. The seat 2 is supported at a predetermined level by the leg frame 6. It is noted that, in the following description, where the backrest 3 and the back kneading device 4 are concerned, the direction of height of the backrest 3 will be referred to as a vertical direction. On the basis of the vertical direction, a horizontal direction (a right-left direction) and a front-rear direction are defined for the sake of explanation of structure. For example, in FIGS. 1 to 9, the direction of from top to bottom (bottom to top) as viewed in the drawing will be referred to as the vertical direction of the apparatus in practice. Moreover, in FIGS. 7 to 9, the direction of from right to left (left to right) as viewed in the drawing will be referred to as the horizontal direction or widthwise direction of the apparatus in practice (within sight of a user sitting on the seat 2) Further, in FIGS. 1 to 6, the direction of from right to left (left to right) as viewed in the drawing will be referred to as the front-rear direction of the apparatus in practice. In FIGS. 1, 7, and 11, the vertical direction, the horizontal direction, and the front-rear direction as employed in the explanation of the embodiment are indicated by the terms "top and bottom", "right and left", and "front and rear", respectively.

The backrest 3 is, at its lower end, pivotally mounted on the rear of the seat 2 or the rear of the leg frame 6 for free back-and-forth rocking motion. The backrest 3 can be brought into a reclining state by a reclining mechanism such as a linear actuator mechanism disposed inside the leg frame 6. Moreover, a leg kneading device 5 is disposed at the front of the seat 2, and also an armrest 7 is disposed on each of the right side and the left side of the seat 2. However, the aforementioned components are cited merely by way of example of constituent parts of the chair-type massage apparatus 1, and no limitation is thus placed as to the presence or absence of such a component and the details of its structure.

As shown in FIG. 11, the back kneading device 4 comprises a massage mechanism 10, a base member 12 for supporting the massage mechanism 10, and a vertical movement mechanism 13 for allowing the base member 12 to move up and down in the vertical direction inside the backrest 3. In addition, the back kneading device 4 is provided with a protruding amount varying mechanism 14 for varying the amount of protruding movement of the massage mechanism 10 in the front-rear direction by moving the upper end of the massage mechanism 10 back and forth relative to the base member 12.

To begin with, the massage mechanism 10 will be explained with reference mainly to FIGS. 1, 7, and 10. The massage mechanism 10 comprises a pair of right-hand and left-hand massage members 17 and a driving section 18 for operating the right-hand and left-hand massage members 17 in a manner to give a massage action. The massage member 17 includes a boomerang-like support arm 20 with its extremities extended obliquely upwardly and obliquely downwardly, respectively, in a frontward direction, and massage treatment elements 21 (21*a* and 21*b*) disposed at the upper end and the lower end, respectively, of the support arm 20. Each massage treatment element 21 can be made for example from a resin or hard rubber material in the form of a thick-walled circular plate, a ball, or the like. Note that, in the following description, the massage treatment element 21 located at the upper end will be termed "upper treatment element 21*a*" and the massage treatment element 21 located at the lower end will be termed "lower treatment element 21*b*" on an as needed basis.

The driving section 18 includes a kneading driving portion 23 for operating the right-hand and left-hand massage members 17 in a manner to move closer to and away from each other and a tapping driving portion 24 for operating the right-hand and left-hand massage members 17 in a manner to produce tapping action in alternate order. The kneading driving portion 23 includes: an inclined rotating member 25 disposed in an embedded state at a central bent part of the support arm 20 of the massage member 17; a first rotary shaft 26 having a horizontally pointing axis installed in a hanging fashion so as to pass through the inclined rotating member 25; a kneading motor 27 for rotatably driving the first rotary shaft 26; and a swing preventive mechanism 28 disposed at the rear of the central bent part of the support arm 20 (shown only in FIG. 10), for restraining the support arm 20 from rotating dependently with the rotation of the first rotary shaft 26. For example, a universal coupling such as a ball joint can be used for the swing preventive mechanism 28.

The inclined rotating member 25 is fitted rotatably about a mounting boss portion via a bearing or the like. The mounting boss portion is attached, in an inclined state, concentrically to the first rotary shaft 26 for unitary rotation. Therefore, as the first rotary shaft 26 is rotated by the actuation of the kneading motor 27, the inclined rotating member 25 is swung to rotate with wobbling about the center of rotation of the first rotary shaft 26 as an axis, and the resultant swingy rotation is transmitted, through the support arm 20, to the massage treatment element 21.

The support arm 20 is kept restrained against dependent rotation with the first rotary shaft 26 by the swing preventive mechanism 28 while given freedom of movement along the front-rear direction, the horizontal direction, and the vertical direction only within a predetermined range of movement. Moreover, the inclination of the inclined rotating member 25 is maintained with a phase difference of 180° with respect to the first rotary shaft 26 between the right-hand and left-hand support arms 20. Thus, in the kneading driving portion 23, the right-hand and left-hand support arms 20 are operated in such a manner that their upper treatment elements 21*a* act to repeat a cycle of movements comprising mutual approach and mutual separation in the horizontal direction and their lower treatment elements 21*b* act to repeat a cycle of movements comprising mutual separation and mutual approach in the horizontal direction. More specifically, when the opposed upper treatment elements 21*a* move closer to each other, the opposed lower treatment elements 21*b* move away from each other, and, when the upper treatment elements 21*a* move away from each other, the lower treatment elements 21*b* move closer to each other. This operation produces a kneading action of the massage member 17.

On the other hand, the tapping driving portion 24 includes: a second rotary shaft 31 having a horizontally pointing axis disposed above the first rotary shaft 26 in parallel relation therewith; a tapping motor 32 for rotatably driving the second rotary shaft 31; right-hand and left-hand eccentric drivers 34 eccentrically mounted with a phase difference of 180° with respect to the right end and the left end, respectively, of the second rotary shaft 31; and a crankshaft 36 (link lever) disposed so as to extend downward with respect to a housing 35 for clutchingly holding the right-hand and left-hand eccentric drivers 34 for free rotation.

The eccentric driver 34 is constructed by attaching an eccentric collar to the inner-ring side or outer-ring side of a bearing so as to yield a nonconformity between the axis of the second rotary shaft 31 and the axis of the housing 35. Moreover, the crankshaft 36 has its lower end coupled to the central bent part of the support arm 20 provided in the massage member 17, and this juncture constitutes the above-described swing preventive mechanism 28 (refer to FIG. 10). That is, the swing preventive mechanism 28 is located at the lower end of the crankshaft 36, and the base part BP of the support arm 20 (the massage member 17) is coupled to the crankshaft through the swing preventive mechanism 28.

Accordingly, in the tapping driving portion 24, upon actuation of the tapping motor 32, the eccentric driver 34 is rotated eccentrically with respect to the axis of the second rotary shaft 31, and correspondingly the housing 35 is moved circumferentially. In this way, a vertical push-pull action is transmitted from the housing 35 to the crankshaft 36. As a consequence, the right-hand and left-hand support arms 20 are each so operated that the massage treatment element 21 wiggles about the first rotary shaft 26, and the upper treatment element 21*a* and the lower treatment element 21*b* are moved toward opposite sides in the front-rear direction. This operation produces a tapping action of the massage member 17.

It is noted that the rocking motion of the right-hand support arm 20 and the rocking motion of the left-hand support arm. 20 occur in alternate order, because the right-hand and left-hand eccentric drivers 34 are arranged with a phase difference of 180°. That is, when the left-hand support arm 20 is so operated that its upper treatment element 21*a* moves forward, the right-hand support arm 20 is so operated that its upper treatment element 21*a* moves backward. On the other hand, when the left-hand support arm 20 is so operated that its lower treatment element 21*b* moves forward, the right-hand support arm 20 is so operated that its lower treatment element 21*b* moves backward.

However, it is to be understood that the operation thus far described is not to be construed as limitation. For example, with the provision of a switching mechanism capable of adjusting the difference in phase between the right-hand and left-hand eccentric drivers 34 to zero, it is possible to make changes to the setting of tapping action (tapping pattern) so that the right-hand and left-hand support arms 20 can be rocked in synchronization with each other in the same direction. Next, the base member 12 for supporting the massage mechanism 10 having the above-described structure, and the vertical movement mechanism 13 for allowing the base member 12 to move up and down inside the backrest 3 will be described.

Figure 7:
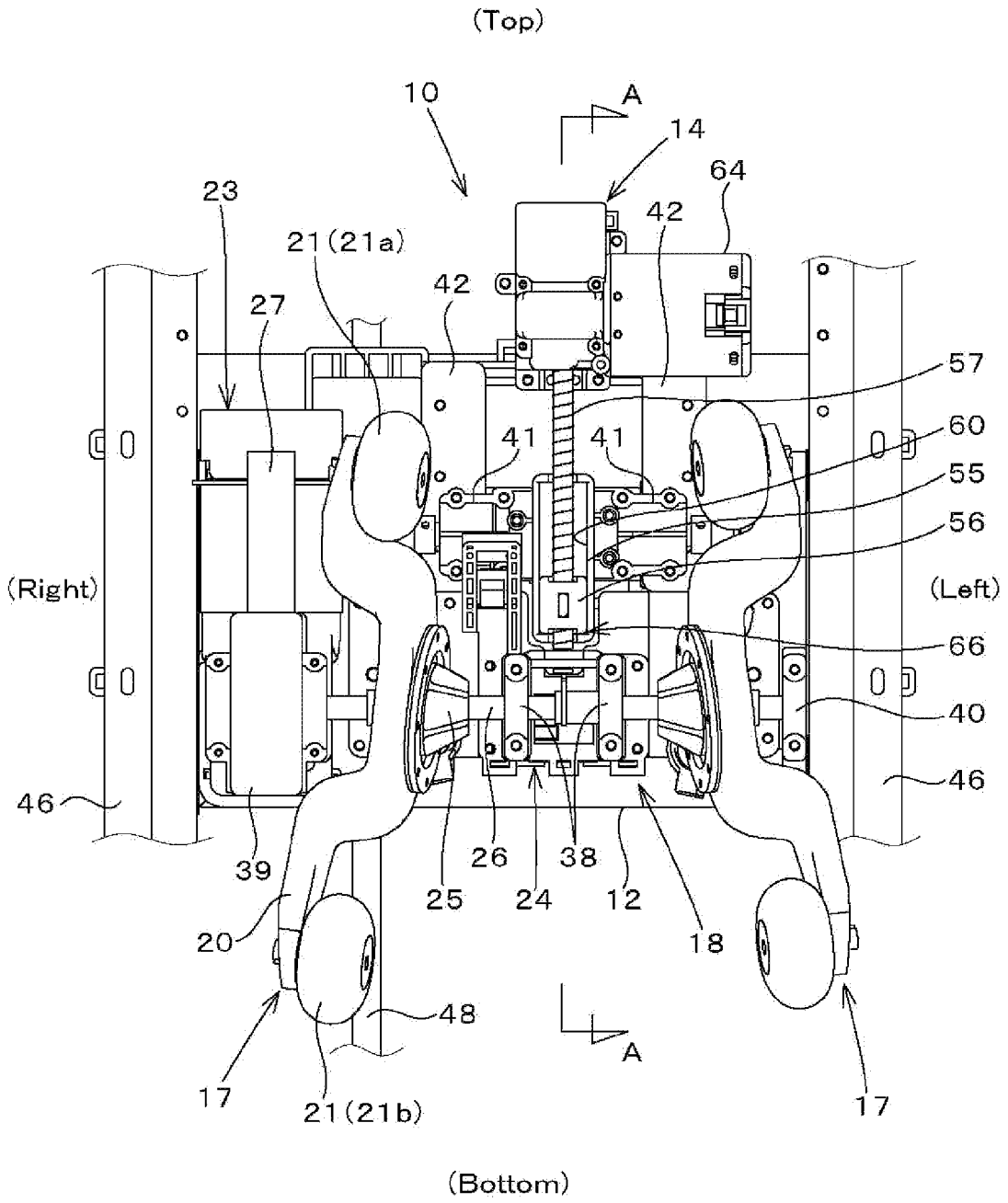
FIG. 7 is a front view showing a state where an upper treatment element of a massage member protrudes forward to the fullest extent.
Figure 8:
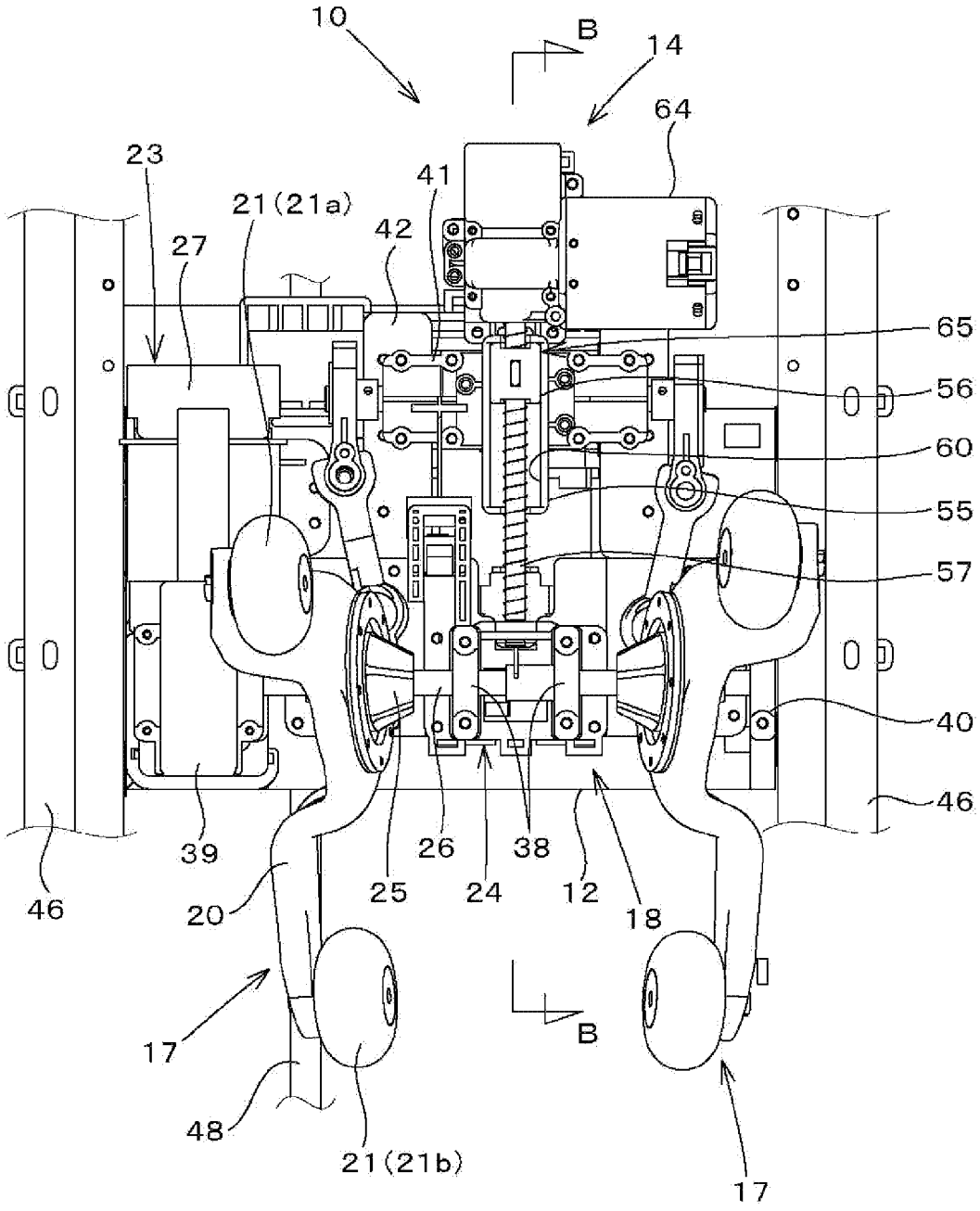
FIG. 8 is a front view showing a state where a lower treatment element of the massage member protrudes forward to the fullest extent.
Figure 9:
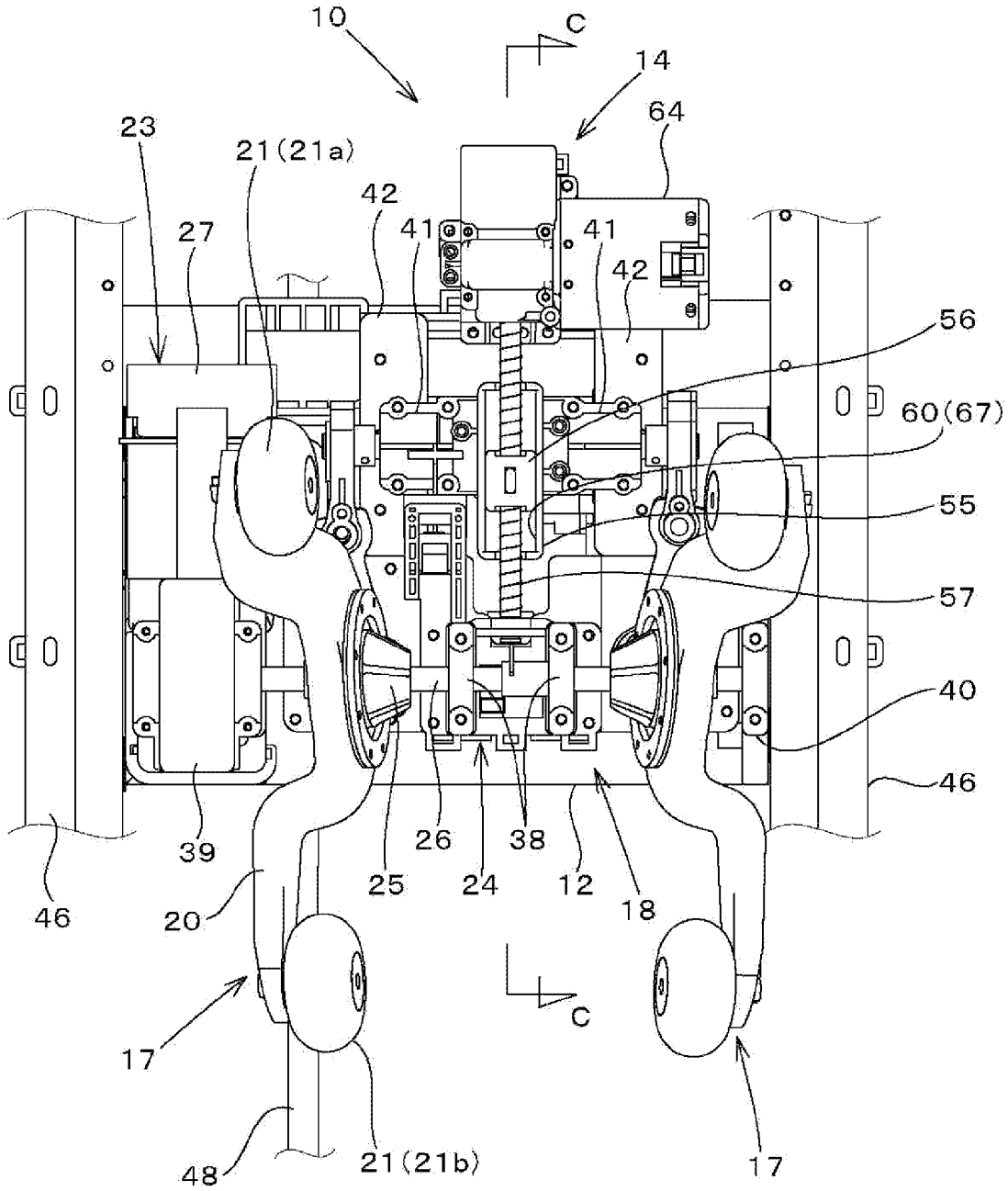
FIG. 9 is a front view showing a state of transition between the state shown in FIG. 7 and the state shown in FIG. 8, where the upper treatment element of the massage member has yet to be caused to protrude forward to the fullest extent, or the lower treatment element of the massage member has yet to be caused to protrude forward to the fullest extent.

The base member 12 supports the massage mechanism 10, with the massage member 17 pointing forward. That is, the base member 12 is disposed at the side of the rear (back) of the massage mechanism 10. To be specific, as shown in FIGS. 7 to 9, the first rotary shaft 26 is, at its central shaft part extending across the right-hand and left-hand massage members 17, rotatably supported by a first bearing portion 38. The first bearing portion 38 is secured to the base member 12. Moreover, the first rotary shaft 26 is so disposed that its rightward extending part passing through the right-hand massage member 17 is coupled to a gear head 39 disposed on the base member 12, and its leftward extending part passing through the left-hand massage member 17 is rotatably retained by a bearing bracket 40 secured to the front of the base member 12. The kneading motor 27 is coupled to the gear head 39.

Figure 2:
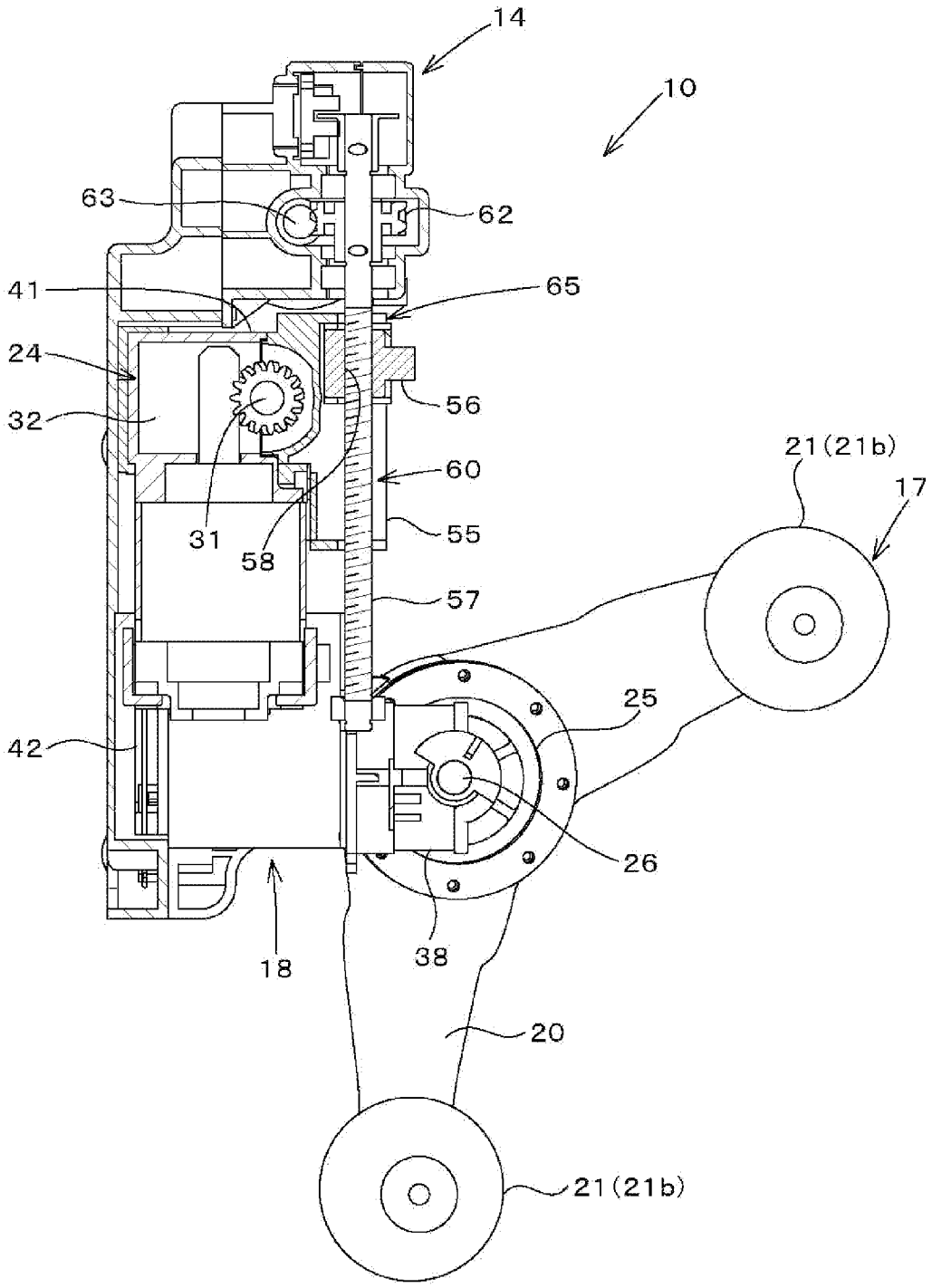
FIG. 2 is a sectional view of the massage mechanism taken along the line B-B of FIG. 8.
Figure 3:
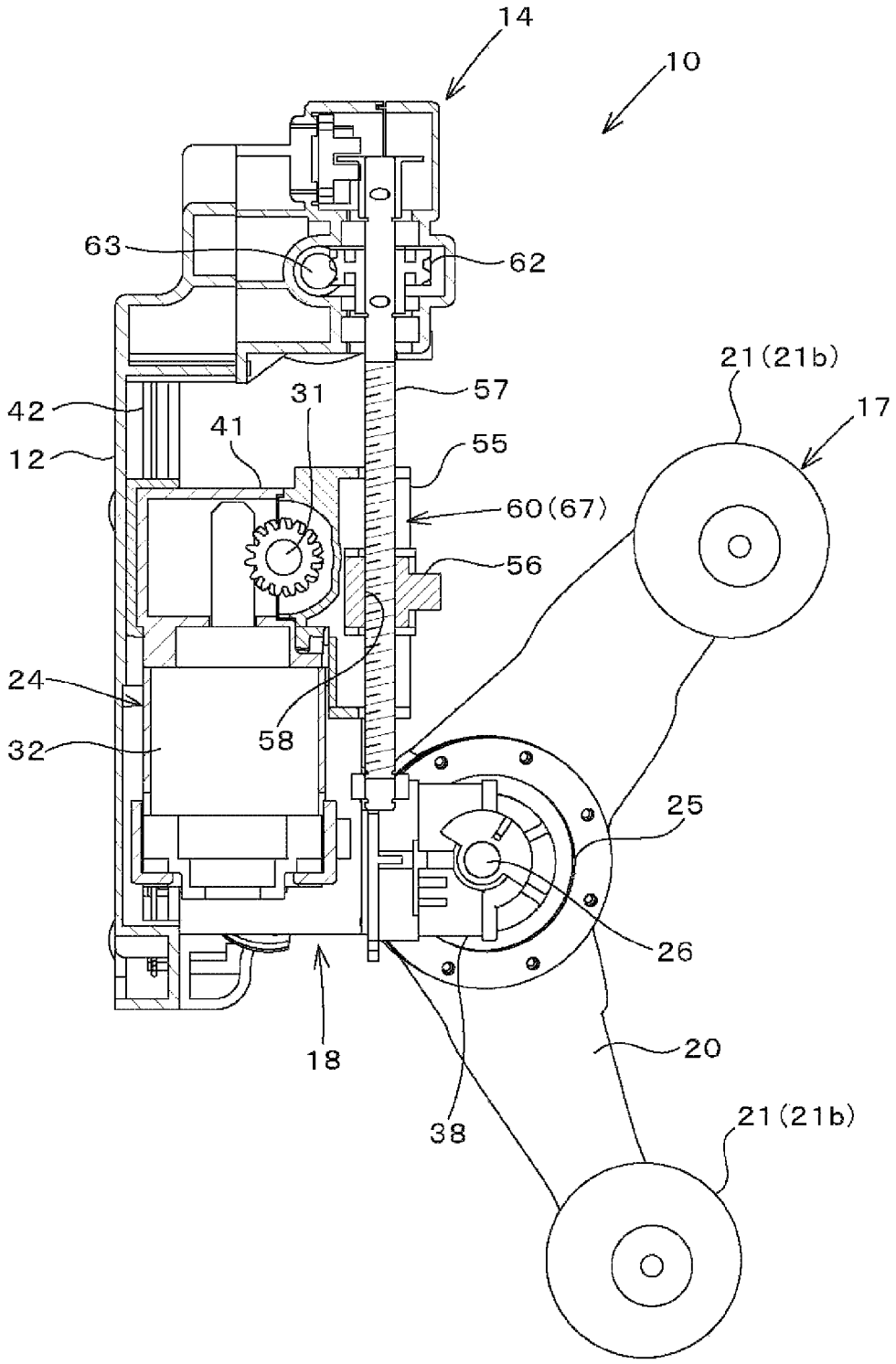
FIG. 3 is a sectional view of the massage mechanism taken along the line C-C of FIG. 9.

Thus, since the first bearing portion 38, the gear head 39, and the bearing bracket 40 that constitute the main part of the kneading driving portion 23 are secured to the base member 12, it follows that the massage mechanism 10 as a whole is kept supported by the base member 12. It is noted that the second rotary shaft 31 of the tapping driving portion 24 is rotatably retained by a second bearing portion 41 disposed above the aforementioned first bearing portion 38, and this second bearing portion 41 is mounted for free up-and-down movement along a pair of right-hand and left-hand vertical rail portions 42 disposed on the front of the base member 12. Moreover, as shown in FIGS. 1 to 3, the tapping motor 32 of the tapping driving portion 24 is disposed at the side of the rear (back) of the second rotary shaft 31 while being coupled integrally with the second bearing portion 41. That is, as the second bearing portion 41 is moved up and down, the tapping motor 32 is moved up and down correspondingly over the base member 12.

In this way, even if the second bearing portion 41 and the tapping motor 32 that constitute the main part of the tapping driving portion 24 are configured for free up-and-down movement, as has already been described, since the main part of the kneading driving portion 23 (the first bearing portion 38 and so forth) is secured to the base member 12, it never occurs that the right-hand and left-hand massage members 17 move up and down relative to the base member 12. Since the second bearing portion 41 of the tapping driving portion 24 and the second rotary shaft 31 supported by the second bearing portion 41 are configured for free up-and-down movement, it is possible to attain the following actions. That is, even when the kneading motor 27 causes the first rotary shaft 26 to rotate, as well as when the tapping motor 32 causes the second rotary shaft 31 to rotate, in principle, the massage member 17 is restrained from rotating about the first rotary shaft 26 dependently with the rotation of the first rotary shaft 26 by the swing preventive mechanism 28.

However, for example, when a leaning load exerted by a user is placed on the massage member 17, a vertical push-pull force is transmitted through the swing preventive mechanism 28 and the crankshaft 36 to the second rotary shaft 31, in consequence whereof there result up-and-down movement of the second bearing portion and the tapping motor 32 along the vertical rail portion 42. Accordingly, the massage member 17 is allowed to rotate or rock about the first rotary shaft 26 only within a predetermined range of movement.

In this construction, with such a massage action, irrespective of whether it is produced by the kneading driving portion 23 or by the tapping driving portion 24, the massage member 17 is rotated about the first rotary shaft 26 so as to conform to irregularities of the back of a user (the spine curved like the letter S), so that the upper and lower treatment elements 21 abut on the back at a substantially uniform pressure. The construction may be configured to be selectable between a mode of operating only one of the kneading driving portion 23 and the tapping driving portion 24 and a mode of operating both of them at the same time.

Meanwhile, the back kneading device 4 is provided with the vertical movement mechanism 13 to allow the base member 12 to move up and down in the vertical direction inside the backrest 3. As shown in FIG. 10, the vertical movement mechanism 13 includes guide rollers 45 disposed on the right side and the left side, respectively, of each of upper and lower areas of the base member 12. The guide roller 45 is rotatably mounted, with its axis of rotation extending horizontally outwardly. In addition, the vertical movement mechanism 13 includes a pair of right-hand and left-hand guide rails 46 in which the guide roller 45 is fitted guidedly for up-and-down movement. The guide rail 46 is installed inside the backrest 3, with its length aligned with the vertical direction.

Moreover, as shown in FIG. 11, in the region between the paired guide rails 46, there is disposed a screw shaft 48 which is rotatably driven by a raising-lowering motor 47. The base member 12 has a built-in nut member (not represented graphically) which threadedly engages the screw shaft 48. Therefore, as the screw shaft 48 is rotatably driven by the actuation of the raising-lowering motor 47, the massage mechanism 10 is, together with the base member 12, moved up and down inside the backrest 3.

Thus, a user sitting on the seat 2 with his/her back pressed against the backrest 3 is able to have a massage over a wide body area including his/her shoulders, back, and waist simply by operating the massage mechanism 10 to move up and down. Next, "the protruding amount varying mechanism 14" constituting distinctive workings of the back kneading device 4 pursuant to the present invention will be explained.

As shown in FIGS. 1 to 3, FIGS. 7 to 9, and so forth, the protruding amount varying mechanism 14 is designed to cause the base part BP of the massage member 17 (the part in which the swing preventive mechanism 28 is attached relatively to the support arm 20) to rock about the rotary shaft 26, so that the amount of protruding movement of the massage treatment element 21 in the front-rear direction can be varied. In other words, the protruding amount varying mechanism 14 functions to move the tapping driving portion 24 (the second bearing portion 41) in the vertical direction to impart axial rocking motion to the base part BP of the massage member 17.

A detailed explanation of the protruding amount varying mechanism 14 will be given below. Firstly, the protruding amount varying mechanism 14 comprises a guide body 55 located midway between the paired right-hand and left-hand massage members 17 in the widthwise direction, a slider 56 disposed inside the guide body 55, and a feed screw shaft 57 for allowing the slider 56 to move up and down inside the guide body 55. The guide body 55 is fixedly placed at the side of the front of the second bearing portion 41 and the tapping motor 32 of the tapping driving portion 24, and has the shape of a tall box with its front part opened (the shape of a rectangular frame). The front-located opening formed in the tall box-shaped guide body constitutes a slot 60 capable of accommodating the slider 56 in which the slider 56 is guided for free vertical movement.

In contrast to such a guide body 55, the slider 56 has a widthwise dimension which is substantially equal to or slightly smaller than the groove width of the slot 60, and is made smaller in vertical dimension (shorter) than the slot 60. Therefore, inside the slot 60, the slider 56 is allowed to move up and down relative to the slot 60 while being kept free of strong backlash in the widthwise direction. Moreover, the slider 56 has a vertical hole drilled all the way through from the upper surface to the lower surface thereof, and the inner surface of this hole is formed with an internal thread portion 58 which threadedly engages the feed screw shaft 57.

The feed screw shaft 57 is inserted into the vertical hole so as to pass vertically through the slider 56 while threadedly engaging the internal thread portion 58 of the inner surface of the hole. A worm wheel 62 is mounted at the upper end of the feed screw shaft 57 for unitary rotation, and a worm gear 63 is disposed in meshing engagement, with its axis of rotation being perpendicular to the worm wheel 62. The worm gear 63 is rotatably driven by an electric motor 64.

That is, upon actuation of the electric motor 64, a resultant rotational driving force is transmitted, through the worm gear 63 and the worm wheel 62, to the feed screw shaft 57. At this time, since the slider 56 is restrained against rotation about the feed screw shaft 57 because of the prevention of widthwise backlash inside the slot 60, it follows that a relative threadable action is produced between the feed screw shaft 57 and the slider 56. This allows the slider 56 to move up and down inside the slot 60.

In the protruding amount varying mechanism 14 having such a structure, as has already been described, by operating the electric motor 64 in a manner to drive the feed screw shaft 57 to rotate in one of rotational directions, the slider 56 is allowed to move upward or downward. It is noted that, in the guide body 55, the upper edge of the slot 60 defines the upper limit of the upward movement of the slider 56 inside the slot 60. As shown in FIGS. 2 and 8, when the slider 56 continues to move further upward even after abutting on the upper edge, a resultant force of the upward movement is transmitted from the slider 56 to the entire guide body 55. This not only causes the guide body 55 to move upward, but also causes the second bearing portion 41 and the tapping motor 32 of the tapping driving portion 24 and formed integrally with the guide body 55 to move upward while being guided by the vertical rail portion 42.

That is, when the second bearing portion 41 reaches the upper-limit position of the vertical rail portion 42, the slider 56 abutting on the upper edge of the slot 60 is restrained against further upward movement inside the guide body 55 correspondingly. The upper edge of the slot 60 in this state will be referred to as a first restraint part 65. Moreover, the lower edge of the slot 60 defines the lower limit of the downward movement of the slider 56 inside the slot 60. As shown in FIGS. 1 and 7, when the slider 56 continues to move further downward even after abutting on the lower edge, a resultant force of the downward movement is transmitted from the slider 56 to the entire guide body 55. This not only causes the guide body 55 to move downward, but also causes the second bearing portion 41 and the tapping motor 32 of the tapping driving portion 24 formed integrally with the guide body 55 to move downward while being guided by the vertical rail portion 42.

That is, when the second bearing portion 41 reaches the lower-limit position of the vertical rail portion 42, the slider 56 abutting on the lower edge of the slot 60 is restrained against further downward movement inside the guide body 55 correspondingly. The lower edge of the slot 60 in this state will be referred to as a second restraint part 66. Moreover, as shown in FIGS. 3 and 9, when the second bearing portion 41 assumes neither the upper-limit position nor the lower-limit position of the vertical rail portion 42, the downward movement of the guide body 55 relative to the slider 56 is permitted until the slider 56 abuts on the lower edge of the slot 60, and also the upward movement of the guide body 55 relative to the slider 56 is permitted until the slider 56 abuts on the upper edge of the slot 60. That is, since the guide body 55 is free to move up and down within a predetermined range of movement, under such a condition, a non-restraint part 67 (a vertical region lying between the first restraint part 65 and the second restraint part 66 inside the slot 60) is created inside the slot 60.

As shown in FIGS. 1 and 7, in the protruding amount varying mechanism 14 having the structure thus far described, for the case of moving the slider 56 downward, the slider 56 abuts on the internal lower edge of the slot 60, whereupon a force of the downward movement is transmitted to the guide body 55. As a consequence, the guide body 55 is, together with the second bearing portion 41 and the tapping motor 32 of the tapping driving portion 24, moved downward while being guided by the vertical rail portion 42. As has already been described, the downward movement of the second bearing portion 41 and the tapping motor 32 travels through the crankshaft 36, thereby causing the base part BP of the massage member 17 to rock downward about the first rotary shaft 26 (as seen in FIG. 10, the base part BP is rotated clockwise about the first rotary shaft 26), in consequence whereof there result the backward movement (retraction) of the upper treatment element 21*a* and the forward movement (forward protrusion) of the lower treatment element 21*b*. Note that, since the slider 56 is brought into engagement with the second restraint part 66 (the lower edge of the slot 60), it follows that the rocking angle RA of the massage member 17 is retained in a condition where the lower treatment element 21*b* assumes a fully advanced position. In this case, even under the pressing force of a user to try to push the lower treatment element 21*b*, the lower treatment element 21*b* remains unmoved.

Likewise, as shown in FIGS. 2 and 8, for the case of moving the slider 56 upward, the slider 56 abuts on the internal upper edge of the slot 60, whereupon a force of the upward movement is transmitted to the guide body 55. As a consequence, the guide body 55 is, together with the second bearing portion 41 and the tapping motor 32 of the tapping driving portion 24, moved upward while being guided by the vertical rail portion 42. The upward movement of the second bearing portion 41 and the tapping motor 32 travels through the crankshaft 36, thereby causing the base part BP of the massage member 17 to rock upward about the first rotary shaft 26 (as seen in FIG. 10, the base part BP is rotated counterclockwise about the first rotary shaft 26), in consequence whereof there result the forward protrusion of the upper treatment element 21*a* and the retraction of the lower treatment element 21*b*. When the slider 56 is brought into engagement with the first restraint part 65 (the upper edge of the slot 60) and is thus no longer moved upward, then the rocking angle RA of the massage member 17 is retained in a condition where the upper treatment element 21*a* assumes a fully advanced position. Also in this case, even under the pressing force of a user to try to push the upper treatment element 21*a*, the upper treatment element 21*a* remains unmoved.

Meanwhile, as shown in FIGS. 3 and 9, during the time the slider 56 exists in the non-restraint part 67, the guide body 55 is allowed to move up and down only within a range of movement equivalent to the vertical length of the non-restraint part 67. Correspondingly, the second bearing portion 41 and the tapping motor 32 of the tapping driving portion 24 are free to move up and down while being guided by the vertical rail portion 42 only within the movement range equivalent to the vertical length of the non-restraint part 67. Accordingly, such a vertical movement of the guide body 55 is transmitted to the crankshaft 36, whereupon the base part BP of the massage member 17 becomes free to rock about the first rotary shaft 26. That is, the rotation of the massage member 17 (the rotation about the first rotary shaft 26) is permitted insofar as the massage member 17 assumes a position free of restraint of the first restraint part 65 as well as the second restraint part 66. As a result, it is possible to achieve a condition where the upper treatment element 21*a* and the lower treatment element 21*b* have freedom of forward protruding movement and retracting movement.

Figure 4:
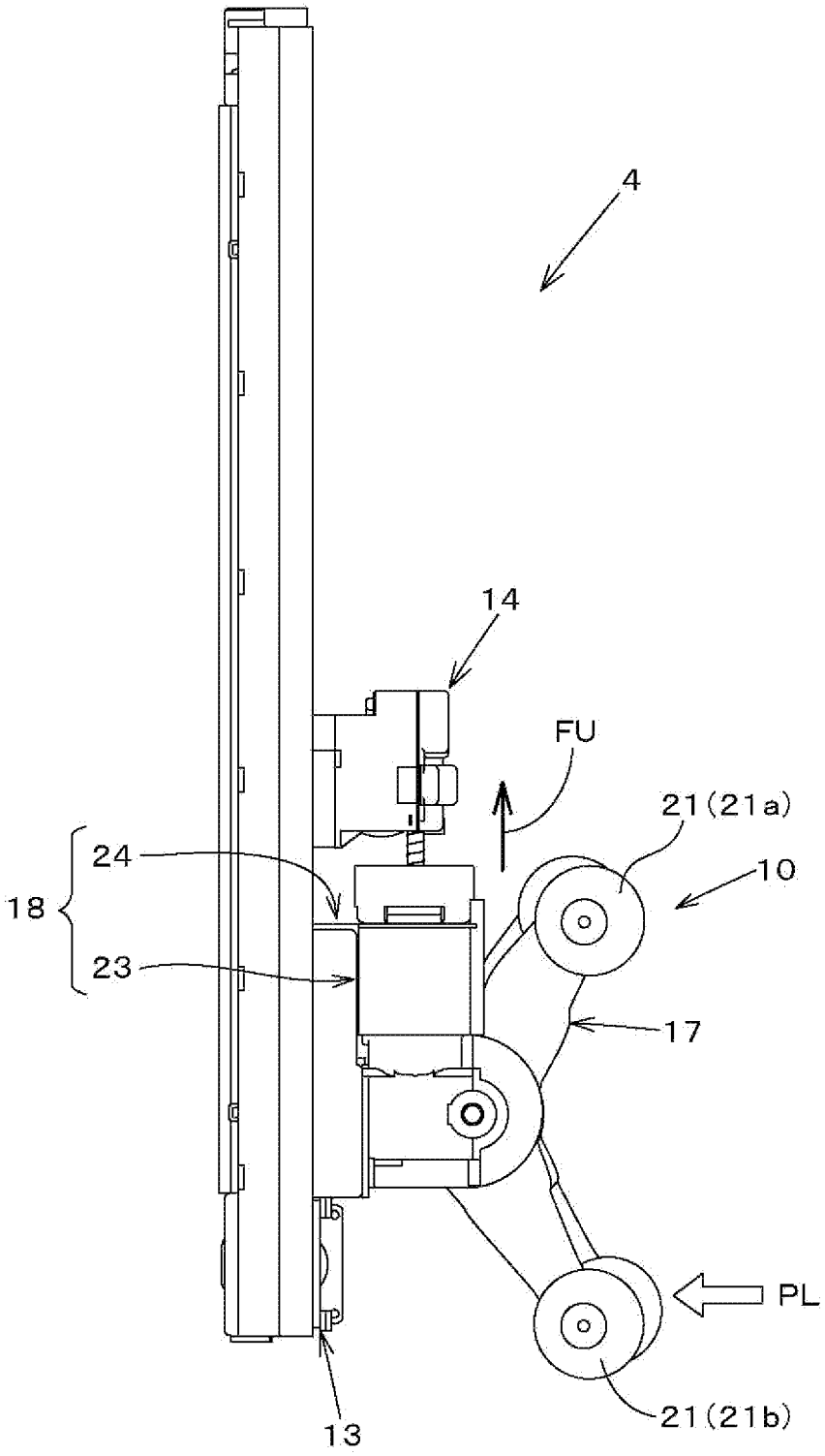
FIG. 4 is a lateral view showing a state where the massage mechanism assumes a lowermost position.
Figure 5:
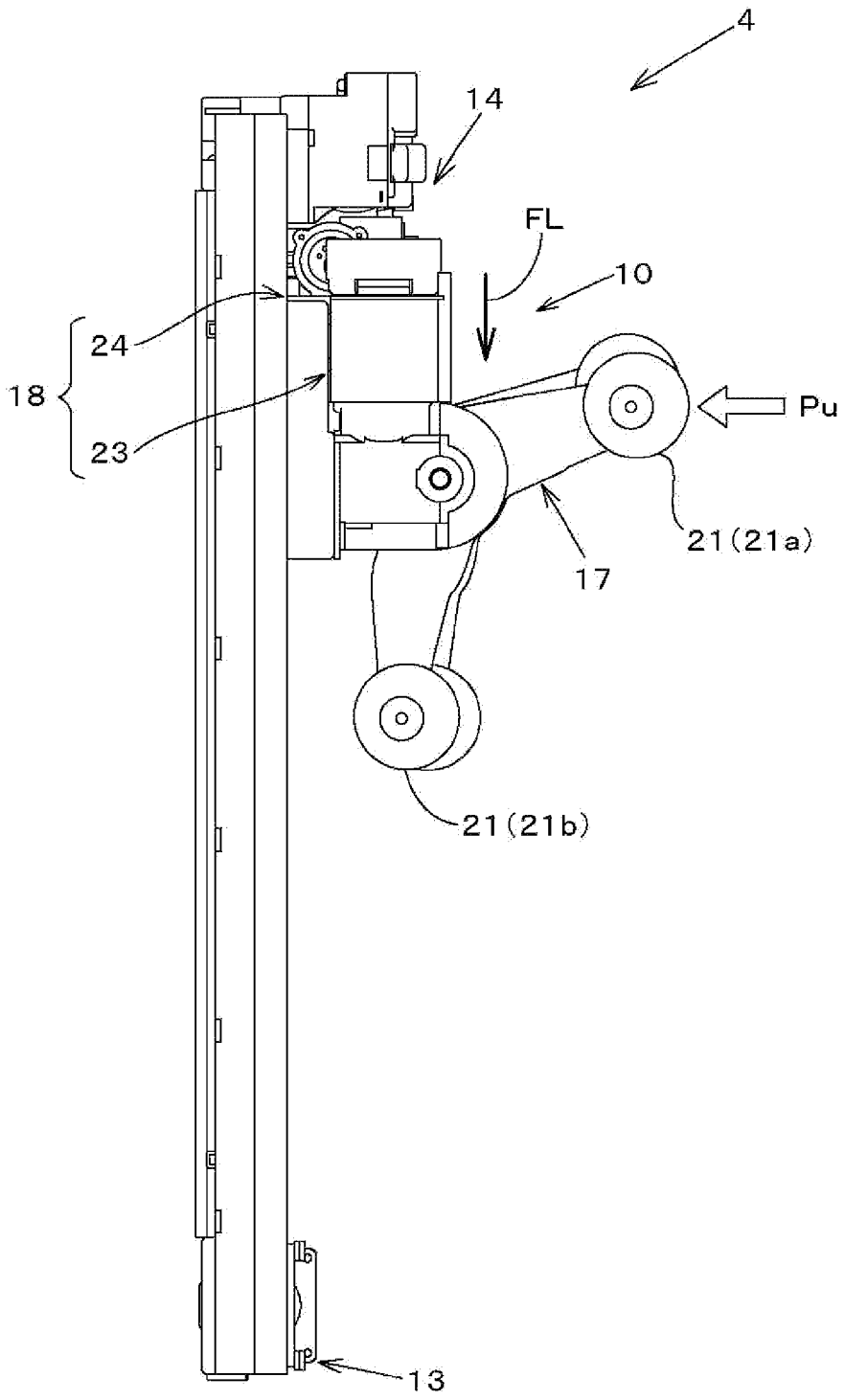
FIG. 5 is a lateral view showing a state where the massage mechanism assumes an uppermost position.
Figure 6:
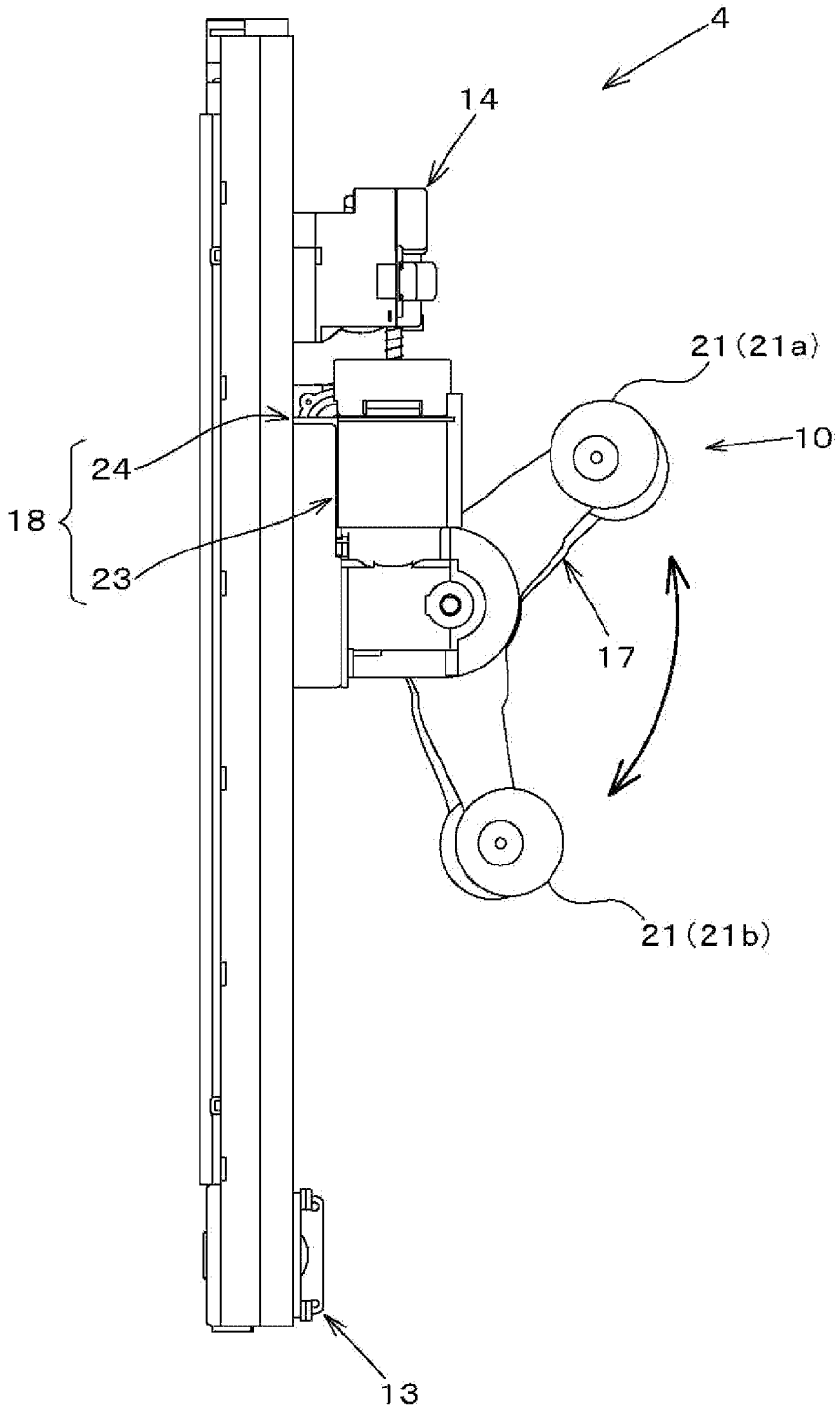
FIG. 6 is a lateral view showing a state where the massage mechanism is located midway between the uppermost position and the lowermost position.

With reference to FIGS. 4 to 6, the operation of such a protruding amount varying mechanism 14 will be described in further detail in relation to the operation of the vertical movement mechanism 13. FIG. 4 shows a state where the massage mechanism 10 is at rest in a lower-end position (the position of the waist of a user). FIG. 5 shows a state where the massage mechanism 10 is at rest in an upper-end position (the position of the shoulders of a user). FIG. 6 shows a state of transition between the state shown in FIG. 4 and the state shown in FIG. 5, where the massage mechanism 10 is in the middle of moving upward or downward.

Firstly, a description will be given as to how the massage mechanism 10 is to be moved upward from the lower position so as to reach the position of the shoulders of a user (a transition from the state shown in FIG. 4 to the state shown in FIG. 6, and from there to the state shown in FIG. 5). The following movement is accomplished by controlling the raising-lowering motor 47 and the electric motor 64 on the basis of a program set in a control section (not represented graphically) provided in the chair-type massage apparatus 1. The prime purpose of the operation of the massage mechanism 10 in the state shown in FIG. 4 is to give a massage to the waist of a user. Therefore, as shown in FIGS. 1 and 7, the protruding amount varying mechanism 14 is moved downward until the slider 56 reaches the second restraint part 66, thereby causing the base part BP of the massage member 17 to rock downward about the first rotary shaft 26. Then, the rocking angle RA of the massage member 17 is retained in a condition where the upper treatment element 21*a* assumes a fully retracted position and the lower treatment element 21*b* assumes a fully advanced position.

Under this condition, as the raising-lowering motor 47 of the vertical movement mechanism 13 is driven to run, the screw shaft 48 is rotated, with a consequent upward movement of the base member 12 having the built-in nut member threadedly engaging the screw shaft 48. At this time, as shown in FIG. 6, the massage mechanism 10 is moved upward concurrently. In accompaniment with the upward movement of the massage mechanism 10, the control section issues a command to the electric motor 64 of the protruding amount varying mechanism 14 in a manner to cause the slider 56 to move upward to the vertical region between the second restraint part 66 and the first restraint part 65 (the non-restraint part 67) as shown in FIGS. 3 and 9. This allows the base part BP of the massage member 17 to rock slightly upward about the first rotary shaft 26, thereby causing the upper treatment element 21*a* to protrude slightly forward and causing the lower treatment element 21*b* to retract slightly backward.

After that, as shown in FIG. 5, the massage mechanism 10 is moved upward even further. When the massage mechanism 10 reaches the position of the shoulders of a user, as shown in FIGS. 2 and 8, the protruding amount varying mechanism 14 is moved upward until the slider 56 reaches the first restraint part 65, thereby causing the base part BP of the massage member 17 to rock upward about the first rotary shaft 26. Then, the rocking angle RA of the massage member 17 is retained in a condition where the upper treatment element 21*a* assumes a fully advanced position and the lower treatment element 21*b* assumes a fully retracted position.

In the state where the upper treatment element 21*a* protrudes forward to the fullest extent, as the tapping driving portion 24 is driven in a manner to impart axial rocking motion to the base part BP of the massage member 17 repeatedly, the upper treatment element 21*a* is moved reciprocally in the vertical direction. In this way, the shoulders of a user between the top and front regions can be massaged reliably with a high degree of effectiveness. Let it be assumed that, under this condition, the upper treatment element 21*a* of the massage member 17 is subjected to a leaning load PU (backward pressing force). In this case, it is expected that a rocking force will be imparted to the massage member 17 to cause it to rotate about the first rotary shaft 26 so as for the upper treatment element 21*a* to move backward beyond the lower treatment element 21*b*, in consequence whereof there results a downward force FL tending to pull the guide body 55 downward.

However, even though the guide body 55 is being pulled down, since a threadable relation is established between the slider 56 and the feed screw shaft 57 in the protruding amount varying mechanism 14, it follows that the guide body 55 is restrained against downward movement at that point in time when the upper edge of the slot 60 abutted on the slider 56. Accordingly, it never occurs that the massage member 17 is inconveniently so operated that the upper treatment element 21*a* moves backward beyond the lower treatment element 21*b*, wherefore the rocking angle RA of the massage member 17 can be retained without fail.

Next, a description will be given as to how the massage mechanism 10 is to be moved downward from the upper position so as to reach the position of the waist of a user (a transition from the state shown in FIG. 5 to the state shown in FIG. 6, and from there to the state shown in FIG. 4). Similarly, the following movement is accomplished by controlling the raising-lowering motor 47 and the electric motor 64 on the basis of the program set in the control section (not represented graphically) provided in the chair-type massage apparatus 1. The prime purpose of the operation of the massage mechanism 10 in the state shown in FIG. 5 is to give a massage to the shoulders of a user. Therefore, as shown in FIGS. 2 and 8, the protruding amount varying mechanism 14 is moved upward until the slider 56 reaches the first restraint part 65, thereby causing the base part BP of the massage member 17 to rock upward about the first rotary shaft 26. Then, the rocking angle RA of the massage member 17 is retained in a condition where the upper treatment element 21*a* assumes a fully advanced position and the lower treatment element 21*b* assumes a fully retracted position.

Under this condition, as the raising-lowering motor 47 of the vertical movement mechanism 13 is driven to run, the screw shaft 48 is rotated, with a consequent downward movement of the base member 12 having the built-in nut member threadedly engaging the screw shaft 48. At this time, as shown in FIG. 6, the massage mechanism 10 is moved downward concurrently. In accompaniment with the downward movement of the massage mechanism 10, the control section issues a command to the electric motor 64 of the protruding amount varying mechanism 14 in a manner to cause the slider 56 to move downward to the vertical region between the second restraint part 66 and the first restraint part 65 (the non-restraint part 67) as shown in FIGS. 3 and 9. This allows the base part BP of the massage member 17 to rock slightly downward about the first rotary shaft 26, thereby causing the upper treatment element 21*a* to retract slightly backward and causing the lower treatment element 21*b* to protrude slightly forward.

After that, as shown in FIG. 4, the massage mechanism 10 is moved downward even further. When the massage mechanism 10 reaches the position of the waist of a user, as shown in FIGS. 1 and 7, the protruding amount varying mechanism 14 is moved downward until the slider 56 reaches the first restraint part 65, thereby causing the base part BP of the massage member 17 to rock downward about the first rotary shaft 26. Then, the rocking angle RA of the massage member 17 is retained in a condition where the upper treatment element 21*a* assumes a fully retracted position and the lower treatment element 21*b* assumes a fully advanced position.

In the state where the lower treatment element 21*b* protrudes forward to the fullest extent, as the tapping driving portion 24 is driven in a manner to impart axial rocking motion to the base part BP of the massage member 17 repeatedly, the upper treatment element 21*a* is moved reciprocally in the front-rear direction. In this way, the waist of a user can be massaged reliably with a high degree of effectiveness. Let it be assumed that, under this condition, the lower treatment element 21*b* of the massage member 17 is subjected to a leaning load PL (backward pressing force). In this case, it is expected that a rocking force will be imparted to the massage member 17 to cause it to rotate about the first rotary shaft 26 so as for the lower treatment element 21*b* to move backward beyond the upper treatment element 21*a*, in consequence whereof there results an upward force FU tending to push the guide body 55 upward.

However, even though the guide body 55 is being pushed up, since a threadable relation is established between the slider 56 and the feed screw shaft 57 in the protruding amount varying mechanism 14, it follows that the guide body 55 is restrained against upward movement at that point in time when the lower edge of the slot 60 abutted on the slider 56. Accordingly, it never occurs that the massage member 17 is inconveniently so operated that the lower treatment element 21*b* moves backward beyond the upper treatment element 21*a*, wherefore the rocking angle RA of the massage member 17 can be retained without fail.

It is noted that, during the interval when the protruding amount varying mechanism 14 is being operated to change the rocking angle RA of the massage member 17 (in the middle of moving the upper treatment element 21*a* forward to the fullest extent, or contrarily moving the lower treatment element 21*b* forward to the fullest extent), as shown in FIGS. 3 and 9, the guide body 55 is allowed to move up and down freely relative to the slider 56 only within a predetermined range of movement. That is, when the leaning load PU or PL is placed on the upper treatment element 21*a* or the lower treatment element 21*b* of the massage member 17, the second bearing portion 41 and the tapping motor 32 of the tapping driving portion 24 are moved up and down together with the guide body 55, whereupon the massage member 17 coupled thereto via the crankshaft 36 is rotated freely about the first rotary shaft 26. Therefore, as shown in FIG. 6, when the massage mechanism 10 is moved up and down under this condition, the massage member 17 is rotated about the first rotary shaft 26 so as to conform to the spine curved like the letter S of the back of a user, so that the upper treatment element 21*a* and the lower treatment element 21*b* abut on the back at a substantially uniform pressure.

Thus, when the slider 56 exists in the non-restraint part 67 of the guide body 55, the tapping driving portion 24 is allowed to move up and down, though only a small amount of travel. Accordingly, the technologies that have already been developed by the applicants of the present application (refer to Japanese Unexamined Patent Publication JP-A 2007-97834) are applicable to this massage mechanism 10. That is, the massage mechanism 10 may be configured to include a shoulder position detecting system composed of: an angle conversion section for converting the angle of rocking motion of the support arm 20 (rocking arm) about the horizontally pointing axis 26 into a rectilinear travel with respect to a position away from the horizontally pointing axis 26; a travel measurement section for measuring the rectilinear travel obtained by conversion in the angle conversion section; and a shoulder position detection section for detecting the position of the shoulders of a user on the basis of the rectilinear travel measured by the travel measurement section.

It will be apparent from the foregoing detailed description that, in the back kneading device 4 pursuant to the present invention, the provision of the protruding amount varying mechanism 14 rather than the advancing and retracting mechanism provided in the conventional back kneading device (refer to Patent Literature 1, for example) eliminates the need to dispose a rail section extending forward and a rock restricting mechanism, with the result that the back kneading device 4 can be made lower in profile in the front-rear direction. Moreover, even if the back kneading device 4 is slimmed down in that way, the massage mechanism 10 can be driven to protrude forward and return to its original normal position with an adequately large amount of travel.

As a matter of course, since the back kneading device 4 can be made slimmer, it is possible to avoid an undesirable increase in the thickness of the backrest 3 of the chair-type massage apparatus 1 in itself. It is noted that, in the chair-type massage apparatus 1, a user sitting on the seat 2 while leaning at his/her back on the backrest 3 is able to have a kneading massage performed by the kneading driving portion 23 of the massage mechanism 10 and a tapping massage performed by the tapping driving portion 24 thereof through the use of the right-hand and left-hand massage members 17 just by setting the back kneading device 4 in motion.

Moreover, by actuating the protruding amount varying mechanism 14 on an as needed basis in accordance with the body shape of a user, target areas of massage, or the desires of a user, it is possible to cause the massage mechanism 10 (the massage member 17) to protrude forward beyond a normal massage position and return it to the original position. In the case of actuating the protruding amount varying mechanism 14, when the massage mechanism 10 is caused to protrude forward, the upper treatment element 21*a* of the massage member 17 is brought into a forward-protruding state, and can be maintained in this state even under the leaning load PU exerted by a user.

On the other hand, when the massage mechanism 10 is caused to retract backward, the lower treatment element 21*b* of the massage member 17 is brought into a forward-protruding state, and can be maintained in this state even under the leaning load PL exerted by a user. Accordingly, the apparatus is capable of providing a massage treatment such as kneading and tapping in localized body regions in an on-target manner (in a pinpoint manner) and thus lives up to user's expectations.

It should be understood that the embodiments as set forth hereinabove are considered in all respects as illustrative only and not restrictive. The scope of the present invention is indicated by the appended claims rather than the foregoing description, and all changes that come within the meaning of and the range of equivalency of the claims are intended to be embraced therein. For example, there is no particular limitation to the details of the structure of the chair-type massage apparatus 1 in itself (other than the basic structure comprising the seat 2 and the backrest 3), as well as to the details of the structure of the massage mechanism 10.

Moreover, the massage members 17 described by way of the embodiment constitute a so-called four-ball structure; that is, each of the massage members 17 is composed of the boomerang-like support arm 20 with its extremities extended obliquely upwardly and obliquely downwardly, respectively, in the frontward direction, and the massage treatment elements 21 (21*a* and 21*b*) disposed at the upper end and the lower end, respectively, of the support arm 20. However, it is no problem to adopt a so-called two-ball structure instead in which the right-hand and left-hand massage members 17 are each provided with a single massage treatment element 21. Further, the chair-type massage apparatus 1 may include a "body-part detection sensor" constructed of a photoelectric sensor or the like, which is mounted inside the backrest 3. In this case, for example, the position of the shoulders of a user is detected by the sensor and, on the basis of the detected user's shoulder position, the apparatus is controlled in the following manner: at the user's shoulder position, the upper-end part of the massage mechanism 10 (the upper treatment element 21*a*) is caused to protrude forward, whereas, at the user's waist position (a location spaced downward from the shoulder position by a predetermined distance), the upper-end part of the massage mechanism 10 (the upper treatment element 21*a*) is caused to retract backward. It is advisable that such a control operation is effected by the control section provided in the chair-type massage apparatus 1.

In addition, the massage member 17 may be constructed of the support arm 20 provided only with the upper treatment element 21*a*.

Figure 13:
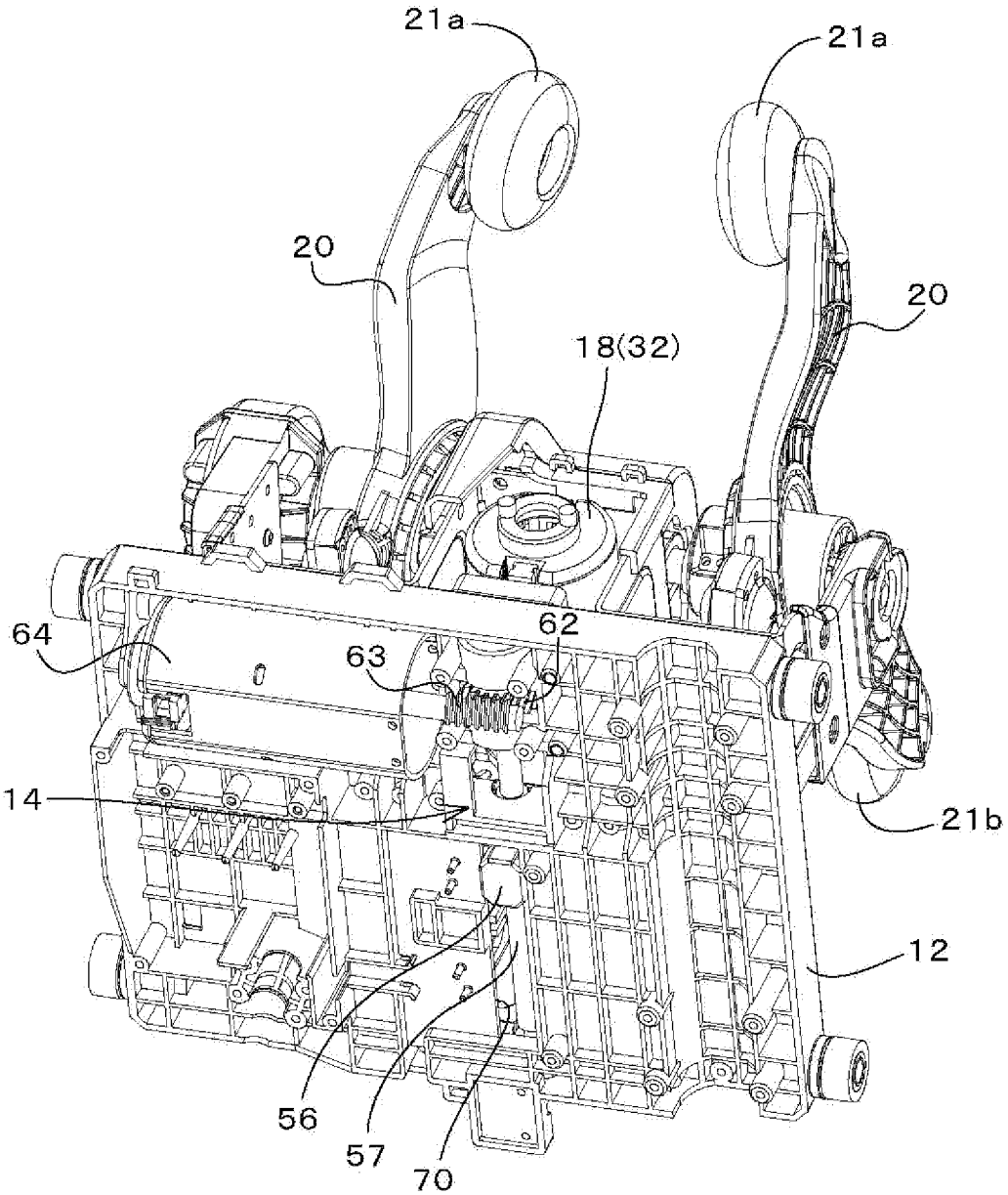
FIG. 13 is a rear perspective view showing another embodiment of a back kneading device pursuant to the present invention.

Alternatively, it is also feasible to adopt the configuration of the protruding amount varying mechanism 14 such as those shown in FIG. 13. In the protruding amount varying mechanism 14 in FIG. 13, the arrangement position of the electric motor 64, which drives the protruding amount varying mechanism 14 so as to vary the protruding amount of the massage treatment element 21 in a front-back direction, is significantly different from that of the protruding amount varying mechanism disclosed in FIGS. 9 and 10 and so forth. That is, the electric motor 64 which drives the protruding amount varying mechanism is disposed at the back side of the base member 12 so that its rotary shaft points in the horizontal direction, and the worm gear 63 is mounted at the end of the rotary shaft of the electric motor 64. In contrast to such an electric motor 64, the feed screw shaft 57 for allowing the slide 56 to move up and down inside the guide body 55 is disposed in the aperture 70, which is provided in the midway of the base member 12 so as to look toward the vertical direction. Inside the aperture 70 there is provided the feeding screw shaft 57 in a freely rotatable way. A worm wheel 62 is mounted at the upper end of the feed screw shaft 57 for unitary rotation, and a worm gear 63 is disposed in meshing engagement, with its axis of rotation being perpendicular to the worm wheel 62. The worm gear 63 varies the amount of protruding movement of the massage treatment element 21 in the front-rear direction by rotating the electric motor 64 in a manner to rotate the feed screw shaft 57 through the worm wheel 62, the slider 56 is allowed to move upward or downward. As just described, disposing the electric motor on the back side of the base member 12 and on the opposite side of the driving section 18 for driving massage member 17 with the base member 12 in-between allows the thickness (front-rear length) and vertical length of the back kneading device 4 as small as possible and it can be realized much thinner and downsized products thereof.

We claim:

1. A back kneading device mounted in a backrest against which a user is able to lean his/her back, comprising:

a massage mechanism including a pair of opposed right-hand and left-hand massage members each having a treatment element for providing a massage and a driving section for transmitting a massage action to the massage members;

a base member for supporting said massage mechanism, with said massage member pointing forward;

a vertical movement mechanism for allowing said base member to move up and down in a vertical direction inside said backrest; and a protruding amount varying mechanism for moving said massage member so that an amount of protruding movement of said treatment element in a front-rear direction can be varied;

wherein the driving section of said massage mechanism includes a kneading driving portion for driving said massage members in such a manner that said opposed treatment elements move closer to and away from each other in a horizontal direction to produce a kneading massage action, and a tapping driving portion for driving said massage member in such a manner that said treatment element is moved reciprocally in the front-rear direction or vertical direction by repetitive axial rocking motions of the base part of said massage member to produce a tapping massage action;

wherein said protruding amount varying mechanism is configured to vary the amount of protruding movement of said treatment element in the front-rear direction by moving said tapping driving portion in the vertical direction while imparting axial rocking motion to a base part of said massage member;

wherein said protruding amount varying mechanism includes:

a first restraint part for retaining a rocking angle of the massage member in a condition where said treatment element assumes a fully retracted position;

a second restraint part for retaining a rocking angle of the massage member in a condition where said treatment element assumes a fully advanced position; and a non-restraint part lying between said first restraint part and said second restraint part, for permitting axial rocking motion of the base part of said massage member, wherein said protruding amount varying mechanism comprises:

a guide body which has a slot pointing in the vertical direction and is secured to said tapping driving portion;

a slider which is shorter than the slot of the guide body and is free to slide in the vertical direction inside the slot; and a feed screw shaft engaging said slider, for allowing said slider to move up and down through a screw rotation, and wherein an upper edge of the slot formed in said guide body serves as the first restraint part, a lower edge of the slot serves as the second restraint part, and a midportion of the slot in the vertical direction serves as the non-restraint part.

2. A back kneading device according to claim 1, wherein the base part of said massage member is pivoted about a horizontally pointing axis to produce the axial rocking motion, and wherein said protruding amount varying mechanism imparts axial rocking motion to the base part of said massage member so that the amount of protruding movement of said treatment element in the front-rear direction can be varied.

3. A back kneading device according to claim 2, wherein said tapping driving portion is configured for up-and-down movement in the vertical direction in said base member, and vertical movement of the tapping driving portion allows said axial rocking motion of the base part of said massage member.

4. A back kneading device according to claim 3, wherein said kneading driving portion includes a first rotary shaft installed in a hanging fashion so as to run in the horizontal direction, said massage member mounted for free rotation relative to the first rotary shaft, and a swing preventive mechanism engaging the base part of the massage member, for restraining the massage member from rotating dependently with a rotation of said first rotary shaft, wherein said tapping driving portion includes a second rotary shaft disposed in parallel with said first rotary shaft, an eccentric driver mounted eccentrically with respect to the second rotary shaft, and a crankshaft which has its one end coupled thereto for reception of an eccentric rotation from said eccentric driver and has the other end coupled to said swing preventive mechanism, for causing the base part of said massage member to rock about the first rotary shaft by exploiting the eccentric rotation from said eccentric driver; and wherein said protruding amount varying mechanism is configured to cause the base part of the massage member to rock about the first rotary shaft via said crankshaft by moving said tapping driving portion in the vertical direction in said base member.

5. A back kneading device according to claim 1, wherein said treatment element is composed of an upper treatment element and a lower treatment element which is supported in a position below the upper treatment element.

6. A back-kneading device according to claim 1, wherein said protruding amount varying mechanism includes an electric motor for driving the protruding amount varying mechanism, and wherein said electric motor is disposed on a back side of the base member and on an opposite side of said driving section for driving the massage member with the base member therebetween.

7. A chair massage apparatus comprising:

a seat; and a backrest which is disposed at a rear of the seat and has the back kneading device as set forth claim 1 mounted therein.

* * * * *